US007806718B2

(12) United States Patent
King et al.

(10) Patent No.: US 7,806,718 B2
(45) Date of Patent: Oct. 5, 2010

(54) ELECTRICAL CONNECTORS AND METHODS OF CONNECTING

(75) Inventors: Thomas A. King, Chesterfield, MO (US); Douglas L. Kirk, Ballwin, MO (US); Dan Julian, Athens, IL (US)

(73) Assignee: Blazing Products Inc., Chesterfield, MO (US)

( * ) Notice: Subject to any disclaimer, the term of this patent is extended or adjusted under 35 U.S.C. 154(b) by 50 days.

(21) Appl. No.: 11/877,543

(22) Filed: Oct. 23, 2007

(65) Prior Publication Data

US 2008/0096415 A1 Apr. 24, 2008

Related U.S. Application Data

(60) Provisional application No. 60/853,672, filed on Oct. 23, 2006.

(51) Int. Cl.
*H01R 4/24* (2006.01)

(52) U.S. Cl. ..... 439/409; 439/711

(58) Field of Classification Search ..... 439/409–413, 439/417–419, 711
See application file for complete search history.

(56) References Cited

U.S. PATENT DOCUMENTS

| | | | | |
|---|---|---|---|---|
| D118,588 | S | 1/1940 | Blackburn | |
| 2,975,392 | A * | 3/1961 | Ludwig | 439/409 |
| 3,124,409 | A | 3/1964 | Nisula | |
| 3,139,315 | A * | 6/1964 | Luis et al. | 439/409 |
| D223,611 | S | 5/1972 | Anderson | |
| 3,675,182 | A | 7/1972 | Gregory | |
| 3,836,941 | A | 9/1974 | Izraeli | |
| 3,936,128 | A | 2/1976 | D'Annessa et al. | |
| 3,973,822 | A | 8/1976 | Sugimoto | |
| 3,990,129 | A | 11/1976 | Cornell et al. | |
| 4,014,078 | A | 3/1977 | Cornell et al. | |
| 4,077,697 | A | 3/1978 | Yates | |
| 4,103,984 | A | 8/1978 | Mixon, Jr. | |

(Continued)

FOREIGN PATENT DOCUMENTS

| | | |
|---|---|---|
| CH | 567 338 | 9/1975 |

(Continued)

OTHER PUBLICATIONS

ExxonMobil Chemical, "Butyl Polymers", 2002; may be seen at www.exxonmobilchemical.com/Public_Products/Butyl_Polymers/Worldwide.

*Primary Examiner*—Hien Vu
(74) *Attorney, Agent, or Firm*—Harness, Dickey & Pierce, P.L.C.

(57) ABSTRACT

An electrical connector and method of making an electrical connection wherein the connector includes a housing having an upper portion and a lower portion rotatable relative to each other, a chamber, a cavity configured to receive a first wire, and a first conductive member positioned within the chamber. The first conductive member is configured to extend into the cavity and establish electrical contact with a conductor of the first wire upon rotation of the upper housing portion relative to the lower housing portion. A second conductive member can be electrically coupled to a conductor of a second wire. The second conductive member is also electrically coupled to the first conductive member such that electrical conductivity can thus be established between the conductor of the first wire and the conductor of the second wire.

26 Claims, 9 Drawing Sheets

U.S. PATENT DOCUMENTS

| | | | | | |
|---|---|---|---|---|---|
| 4,103,986 | A | | 8/1978 | Izraeli | |
| 4,269,465 | A | | 5/1981 | Mueller | |
| 4,277,124 | A | | 7/1981 | Loose et al. | |
| 4,437,723 | A | | 3/1984 | Narozny | |
| 4,444,447 | A | | 4/1984 | Markwardt | |
| 4,548,462 | A | | 10/1985 | Cornell | |
| 4,561,682 | A | | 12/1985 | Tisserat | |
| 4,564,256 | A | | 1/1986 | Damiano et al. | |
| 4,653,831 | A | | 3/1987 | Wilson et al. | |
| 4,842,546 | A | | 6/1989 | Song | |
| 4,983,932 | A | | 1/1991 | Kitagawa | |
| 4,995,827 | A | | 2/1991 | Rudoy | |
| 4,995,829 | A | | 2/1991 | Geib et al. | |
| D315,139 | S | | 3/1991 | Blaha | |
| D315,143 | S | | 3/1991 | Blaha | |
| 5,030,136 | A | | 7/1991 | Reinhardt et al. | |
| 5,041,012 | A | * | 8/1991 | Caprio | 439/413 |
| 5,162,772 | A | | 11/1992 | May | |
| D333,121 | S | | 2/1993 | Craveiro | |
| 5,254,015 | A | * | 10/1993 | Robertson | 439/410 |
| 5,281,164 | A | | 1/1994 | Gan | |
| 5,470,250 | A | | 11/1995 | Hawk et al. | |
| 5,765,962 | A | | 6/1998 | Cornell et al. | |
| 6,120,334 | A | | 9/2000 | Timsit et al. | |
| 6,135,804 | A | | 10/2000 | Lux | |
| 6,241,563 | B1 | | 6/2001 | Warner et al. | |
| 6,250,948 | B1 | | 6/2001 | Daoud | |
| D484,400 | S | | 12/2003 | Blake et al. | |
| 6,732,983 | B1 | | 5/2004 | Blake et al. | |
| 6,863,558 | B2 | * | 3/2005 | Negishi et al. | 439/404 |
| 7,066,764 | B2 | * | 6/2006 | Bolouri-Saransar | 439/409 |
| D533,509 | S | | 12/2006 | Wu | |
| 7,144,269 | B2 | * | 12/2006 | Libby et al. | 439/409 |
| 7,335,050 | B2 | | 2/2008 | Kirk et al. | |
| D575,230 | S | | 8/2008 | Bishop et al. | |
| D575,738 | S | | 8/2008 | Kirk et al. | |
| 2007/0004269 | A1 | | 1/2007 | Kirk et al. | |

FOREIGN PATENT DOCUMENTS

| | | |
|---|---|---|
| DE | 39 42 520 | 6/1991 |
| EP | 1492199 | 12/2004 |
| FR | 2254133 | 7/1975 |
| WO | 01 91239 | 11/2001 |

* cited by examiner

FIG. 6A
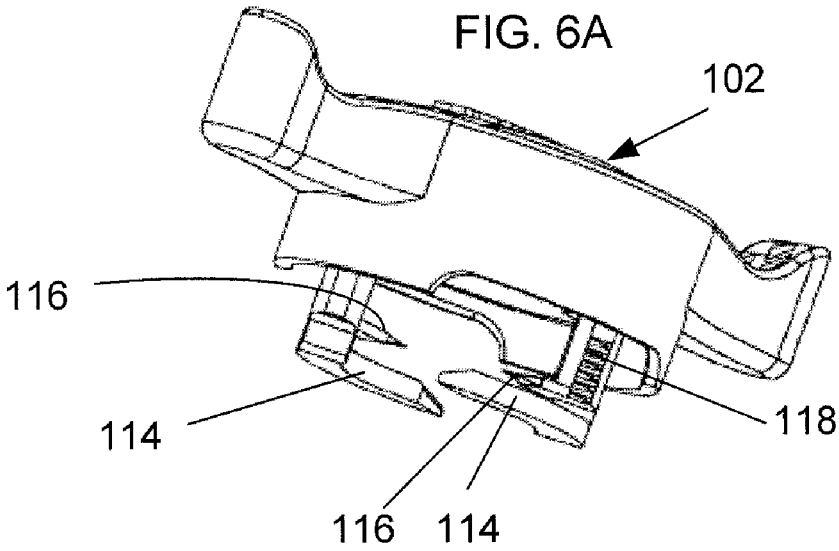
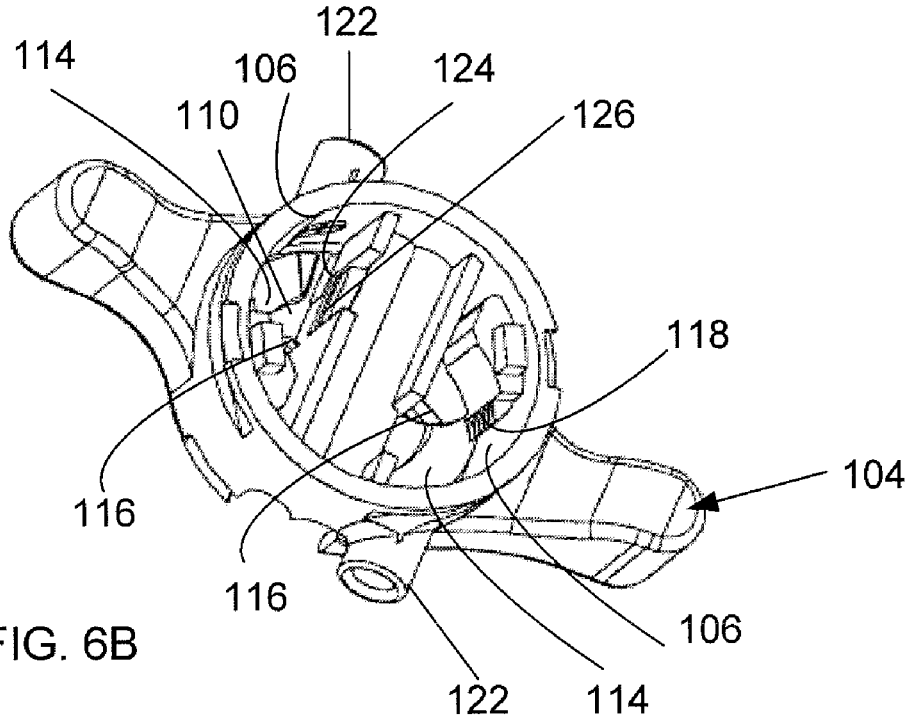
FIG. 6B

ELECTRICAL CONNECTORS AND METHODS OF CONNECTING

CROSS-REFERENCE TO RELATED APPLICATION

This application claims the benefit of U.S. Provisional Application No. 60/853,672, filed on Oct. 23, 2006, the entire disclosure of which is incorporated herein by reference.

FIELD

The present disclosure generally relates to a connector, and more specifically to an electrical connector for connecting wires (e.g., a second wire to a first wire, etc.).

BACKGROUND

The statements in this section merely provide background information related to the present disclosure and may not constitute prior art.

In recent years, there has been a continual increase in the use of electrical equipment in various industries, and the need for connecting various components of the equipment or systems containing disparate electrical components. By way of example, both lawn sprinkler systems and landscape lighting systems include a plurality of electrical components that must be electrically connected.

In these situations, it is common practice to electrically connect wires by means of an electrical connector. Some connectors require that the wires to be connected be stripped of their insulated covering to expose the electrical conductor prior to insertion of the wire into the connector. However, in practice it is very desirable to connect wires without first having to remove the insulation on the wire. To address this, connectors have been designed that include one or more electrically conductive pins for penetrating the insulation and contacting the conductor. Often, the most common low voltage connectors are hard-wired to a low voltage light or other device that is then tapped into the main low voltage line.

In practice, a pin is incorporated into each of two mating parts that are coupled together to tap the conductors of the electrical wire placed between the two mating parts. The two mating parts may include engaging members such as arms with barbs that must be squeezed or urged together with a tool such as a pair of pliers. However, the pins are often bent or only make partial or poor electrical contact with the electrical conductor within the wire. Additionally, these types of connectors do not provide any form of protection for the point of electrical contact and therefore are susceptible to the impacts of the operating environment, including, for example, stress, strain, and corrosion.

These electrical connectors are often placed in an operating environment that is hazardous or that can include hazardous elements or situations. Water or moisture infiltration into the electrical connectors can cause electrical shorting, rust buildup, a deterioration of the electrical connection, the generation of heat or hot spots, and can result in ruined electrical equipment. Keeping the outdoor electrical connections watertight is difficult and is usually only minimally provided for by the electrical connectors.

SUMMARY

Exemplary embodiments of the present disclosure are generally directed toward electrical connectors. In one exemplary embodiment, an electrical connector generally includes a housing having an upper portion and a lower portion rotatable relative to each other, a chamber, and a cavity configured to receive a first wire. A first conductive member is positioned within the chamber and is configured to extend into the cavity and establish electrical contact with a conductor of the first wire upon rotation of the upper housing portion relative to the lower housing portion. A second conductive member is capable of being electrically coupled to a conductor of a second wire. The second conductive member is electrically coupled to the first conductive member, wherein electrical conductivity can be established between the conductor of the first wire and the conductor of the second wire through the second conductive member.

In another exemplary embodiment, an electrical connector generally includes a housing having an upper portion and a lower portion rotatable relative to each other, a chamber, a cavity configured to receive a first wire, a second wire passageway for receiving a second wire, a retention member passageway between the chamber and the cavity, and a connection member passageway between the chamber and the cavity. An engagement member of the connector includes a retention member, a first conductive member, and a second conductive member electrically coupled to the first conductive member. The retention member is configured to extend through the securing member passageway and into and across at least a portion of the cavity to at least partially secure a first wire received within the cavity. The first conductive member is configured to extend through the connection member passageway and into the cavity to establish electrical contact with a conductor of the secured first wire, and the second conductive member is configured to rotate within the chamber and complete electrical contact with a conductor of a second wire received within the chamber through the second wire passageway. Each of these is responsive to a rotation of the upper housing portion relative to the lower housing portion.

Other exemplary embodiments of the present disclosure are directed toward exemplary methods of establishing an electrical connection, for example, between wires. One exemplary method includes inserting a portion of a first wire into an open cavity defined by a housing having an upper portion and a lower portion, rotating the upper housing portion relative to the lower housing portion, and establishing electrical conductivity with a conductor of the first wire responsive to the rotating, wherein establishing includes completing electrical contact with a conductor of a second wire.

Another exemplary method includes inserting a portion of a first wire into an open cavity defined by a housing having an upper portion and a lower portion, rotating the upper housing portion relative to the lower housing portion, securing the first wire within the open cavity responsive to the rotating, and establishing electrical conductivity with a conductor of the first wire responsive to the rotating, wherein establishing includes completing electrical contact with a conductor of a second wire.

Further aspects of the present disclosure will be in part apparent and in part pointed out below. It should be understood that various aspects of the disclosure may be implemented individually or in combination with one another. It should also be understood that the detailed description and drawings, while indicating certain exemplary embodiments of the disclosure, are intended for purposes of illustration only and should not be construed as limiting the scope of the disclosure.

DRAWINGS

The drawings described herein are for illustration purposes only and are not intended to limit the scope of the present disclosure in any way.

FIG. 6A is a perspective view of the upper housing of the electrical connector of FIG. 1.

FIG. 6B is a perspective view of the lower housing portion of the electrical connector of FIG. 1.

Corresponding reference numerals indicate corresponding parts and features throughout the drawings.

DESCRIPTION

Figure 1:
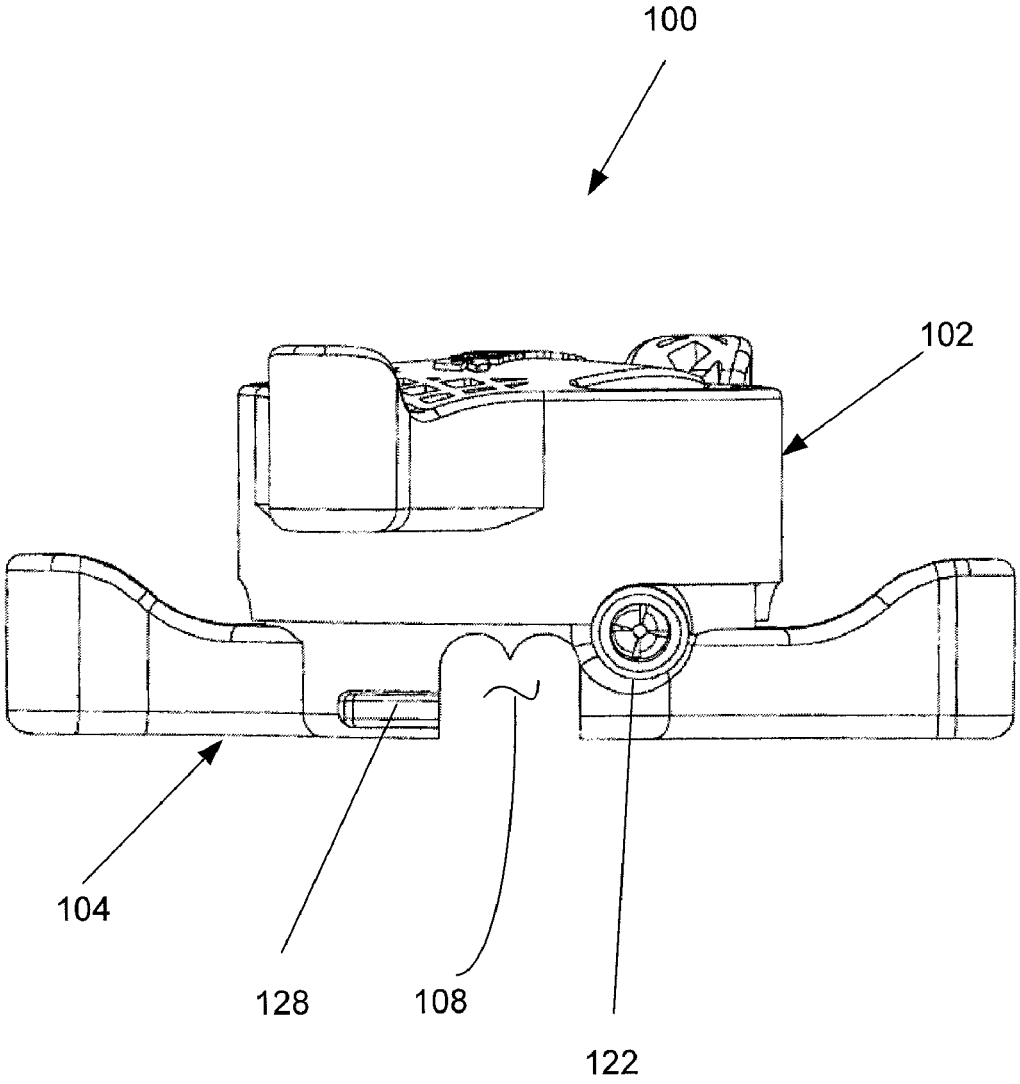
FIG. 1 is a front view of an electrical connector in one exemplary embodiment, without wires, and in an open position, for example, prior to being coupled to wires.

The following description is merely exemplary in nature and is not intended to limit the disclosure, its applications, or uses.

In one exemplary embodiment, an electrical connector may include a housing having an upper portion and a lower portion rotatable relative to each other, a chamber, and a cavity configured to receive a first wire and a first conductive member positioned within the chamber. The first conductive member is configured to extend into the cavity and establish electrical contact with a conductor of the first wire upon rotation of the upper housing portion relative to the lower housing portion. A second conductive member can be electrically coupled to a conductor of a second wire and electrically coupled to the first conductive member, wherein electrical conductivity is established between the first wire conductor and the second wire conductor through the second conductive member.

The housing can include a connection member passageway configured to allow passage of the first conductive member from the chamber into the cavity. Generally, as the conductor of the first wire is centered within an insulating covering of the wire, the connection member passageway can be aligned about a center of a position within the cavity to align the connection member passageway with the conductor when the first wire is positioned in the cavity. The connection member passageway can be positioned in any position about the housing (either the upper or lower portions connecting the cavity to the chamber). The chamber can be substantially or completely enclosed by the upper and/or lower housing portions. The cavity can be positioned on any portion of the housing and can include a cavity formed by an outer surface of the housing. In some exemplary embodiments, the cavity is formed on an outer surface and is configured to receive a mid-portion of a first wire (other than an end portion). In some exemplary embodiments, the cavity is formed on a top, side or bottom surface of the housing.

The second conductive member may be electrically coupled to the conductor of the second wire for completing the electrical connectivity between the first conductor and the second conductor whereby a tapping of electrical power is enabled. The second conductor can be attached in a permanent or semi-permanent manner that can include, by way of example, a coupling using solder, welds, clamps, screws, nuts, compression bolts, wire wraps, push pins, push slots, etc. In such exemplary embodiments, the electrical connector can be attached to a second wire during assembly of a second power using device such as a low voltage light, by way of example. In other exemplary embodiments, the second conductive member can be configured to rotate within the chamber to fracture a portion of any insulating covering of the second wire positioned in the chamber such as through a second wire passageway or possibly via a second cavity and rotating member. In this manner, the second conductive member completes the electrical coupling to the second wire conductor through the rotation of the upper housing portion relative to the lower housing portion. This could be simultaneous with the first conductive member establishing electrical contact with the first wire conductor, or could be prior to or following such contact. Generally, such an exemplary embodiment will establish two connections to establish the electrical connectivity.

In some exemplary embodiments, a moisture resistant encapsulant can be positioned within the chamber to at least partially restrict the introduction of moisture through the second wire passageway and at least partially seal the chamber. In this manner, the conductive members can be partially protected from elements such as water which may cause corrosion of the elements. In some embodiments, the presence of the moisture resistant encapsulant can enable the use of conductive material that would otherwise be susceptible to corrosion or other degradation. For example, in some embodiments, the conductive members described herein could be made of copper, silver, gold, titanium, or zinc, each of which could benefit from the presence of the moisture resistant encapsulant. The moisture resistance encapsulant can be any type of sealing material that resists moisture and can include a viscous or non-viscous material and/or a hardening or non-hardening epoxy or potting compound, silicon material.

In some exemplary embodiments, the first conductive member and the second conductive member are each portions of a monolithic member body configured to electrically couple the first and second conductive members. The monolithic body can be formed from any type of conductive material such as a metal and in some embodiments, can be machined or molded such as from a powdered metal, by way of example. In other exemplary embodiments, the conductive members can be separate conductive members that are connected by auxiliary conductive members such as a trace or wire.

In some exemplary embodiments, the cavity and housing can be formed to enable a user of the electrical connector to position a first wire in the cavity with a finger, hand or otherwise during the rotation of the two housing portions. However, in some exemplary embodiments, a retention fixture or member can be utilized to hold the connector onto the first wire and to hold the first wire in the cavity for ease in the first conductive member completing contact, through penetration, fracturing or otherwise, with the first wire.

In some exemplary embodiments, a retention member can be included that is adapted to at least partially secure the first wire within the cavity. This can be a mechanical retention member that is manipulated by the user, such as a sliding member or a cap that is connected to the housing or incorporated into the housing. However, in other exemplary embodiments, the housing includes a retention member passageway configured for passage of a movable retention member that is located in the chamber. The retention member passageway connects the cavity to the chamber such that the retention member positioned within the chamber can extend through the retention member passageway. For example, during rotation of the two housing portions relative to each other, the retention member can be configured to at least partially extend from the chamber into the cavity to partially or fully secure the received first wire in the cavity. In this manner, the rotation of the upper housing portion relative to the lower housing portion not only makes contact with the first conductor of the first wire, and possibly the contact of the second connective member with the conductor of the second wire, but also to activate or move the retention member into the cavity and secure the first wire in the cavity. Of course this will also result in the electrical connector being secured, at least in part, to the first wire. The retention member can be configured or dimensioned to secure the first wire before the first conductive member couples with or establishes the electrical contact with the conductor of the first wire. For example, in one exemplary embodiment, the retention member is configured to at least partially secure the received first wire before the first conductive member extends into the cavity.

In another exemplary embodiment, the cavity can be formed on a lower surface of the lower housing body, and the retention member passageway can be positioned proximate to a bottom surface of the lower housing portion. The lower housing can include a securing fixture for receiving an end of the retention member following the rotation, and the retention member may be dimensioned to extend across the cavity from the retention member passageway and engage with the securing fixture.

As noted above, a moisture resistant encapsulant can be positioned within the chamber to encapsulate a portion of the first conductive member and a portion of the second conductive member, to encapsulate the fractured portion of the second wire, and to at least partially restrict the introduction of moisture into the chamber from the retention member passageway, the connection member passageway, and the second wire passageway.

As noted above, the first conductive member and the second conductive member can be integrally formed such as through a monolithic body. Similarly, the retention member can also be formed with one or both of the first conductive member or second conductive members. Retention member can be electrically coupled or electrically isolated from one or both of the first and second conductive members.

The exemplary electrical connections can be responsive to a rotation of the housing portion relative to the lower housing portion. This rotation can be imparted as a function of a user using his/her hand or hands, or could be with the use of one or more tools. In some exemplary embodiments, the rotation required for such connections may be less than about 360 degrees, but can also be less than about 180 degrees. In other exemplary embodiments, the rotation can be less than about 135 degrees, or can be less than about 90 degrees. The exact degrees of rotation required can be determined as a function of design, but in some exemplary embodiments may be less than about 180 degrees or less than about 90 degrees for user functionality and use.

This can be a function, at least in some manner, of one or both of a user gripping feature or fixture associated with the housing. For example, in one exemplary embodiment the upper housing portion includes an upper user grip fixture and the lower housing portion includes a lower user grip fixture, each user grip fixture being configured to enable a user to rotate the upper housing portion relative to the lower housing portion. By way of example, one or both of the upper and lower user grip fixtures is selected from the group consisting of a wing, a knurl, and an edged shape.

Figure 3:
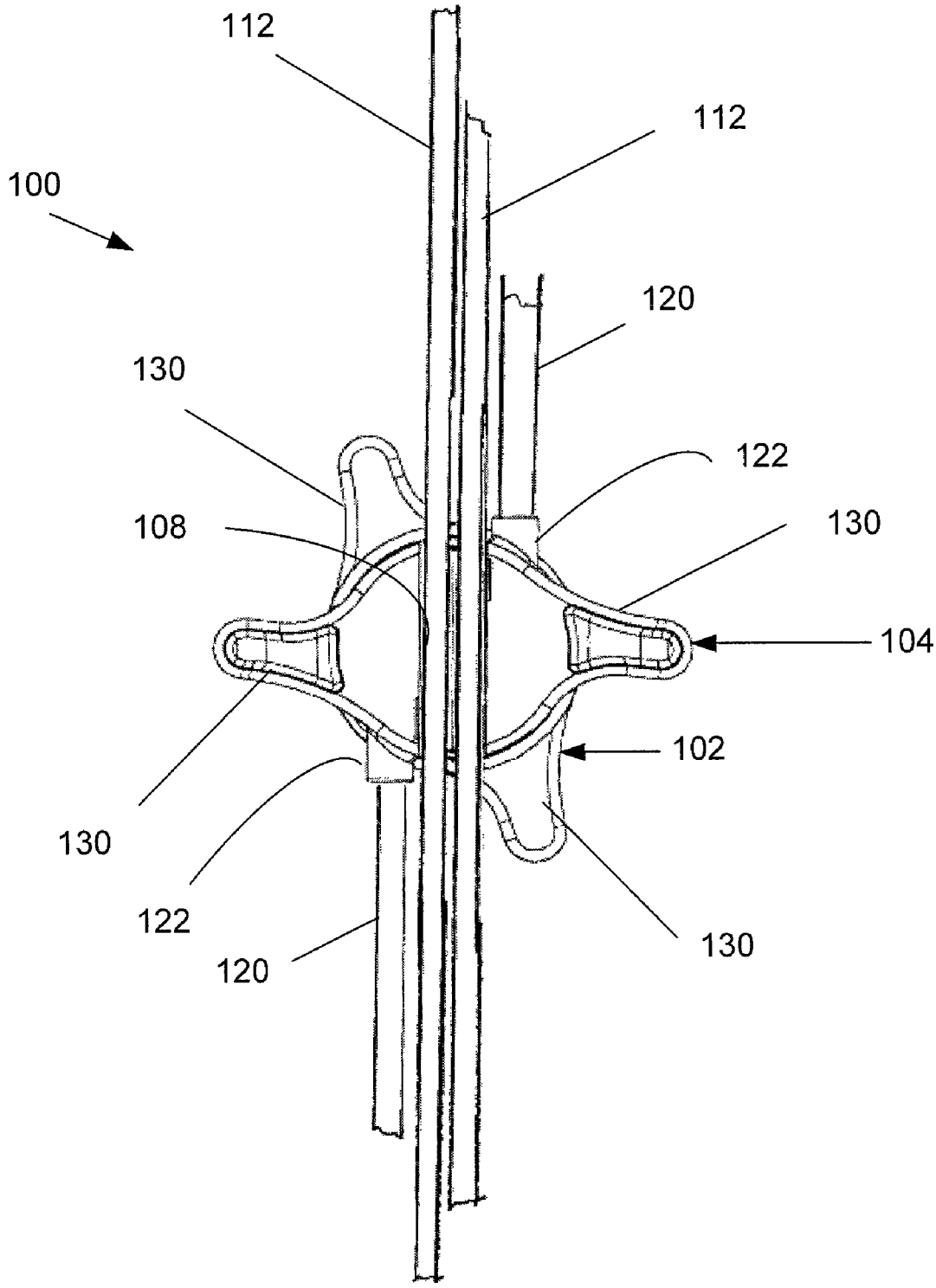
FIG. 3 is a bottom view of the electrical connector of FIG. 1 with wires positioned in the connector and in an open position.
Figure 4:
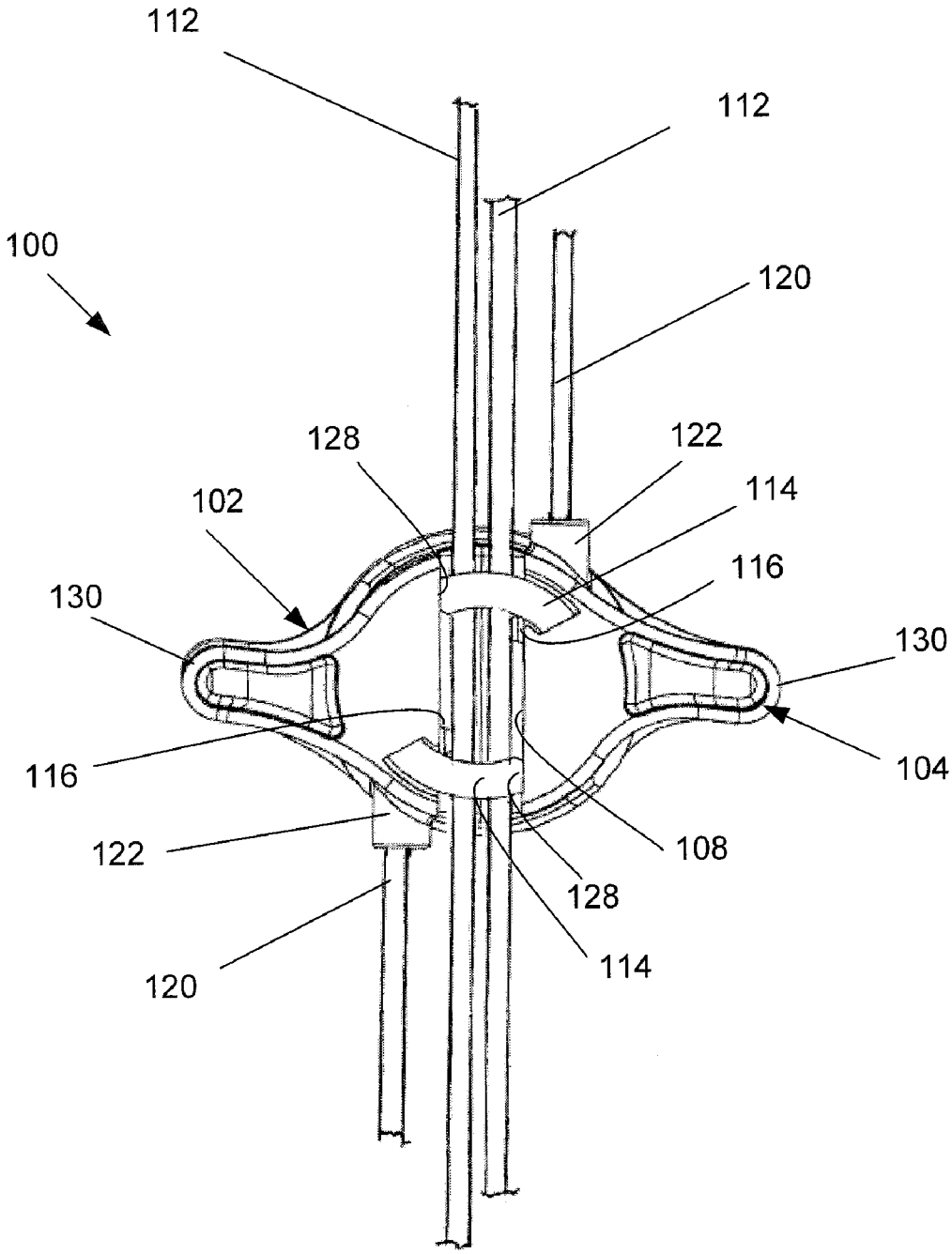
FIG. 4 is a bottom view of the electrical connector of FIG. 1 with wires positioned in the connector and in a rotated position.

Referring now to FIG. 1, one exemplary embodiment of an electrical connector is illustrated. Connector 100 has an upper housing portion 102 and a lower housing portion 104. The upper housing portion 102 and lower housing portion 104 generally define a chamber 106 (FIG. 6B) within the lower housing portion 104, and the lower housing portion 104 has a cavity 108 configured to receive a first wire (e.g., primary wire 112; FIGS. 3 and 4). A retention member 114, shown in FIG. 2, positioned within chamber 106 (FIG. 6B) is configured to at least partially extend into and across at least a portion of the cavity 108 and at least partially secure the received primary wire 112 (FIGS. 3 and 4) within the cavity 108 upon rotation of the upper housing portion 102 relative to the lower housing portion 104. A first conductive member (e.g., primary conductive member 116) also positioned within the chamber 106 (FIG. 6B) of the lower housing portion 104 is configured to extend into the cavity 108 and establish electrical contact with a conductor of the primary wire 112 upon rotation of the upper housing portion 102 relative to the lower housing portion 104. A second conductive member (e.g., secondary conductive member 118; see FIG. 7) is electrically coupled to the primary conductive member 116 and configured to rotate within the chamber 106 (FIG. 6B) of the lower housing portion 104 to fracture a portion of any insulating covering of a second wire (e.g., secondary wire 120; FIGS. 3 and 4) received into a secondary wire passageway 122, for example, to complete electrical contact with a conductor of the secondary wire 120 (FIGS. 3 and 4) upon rotation of the upper housing portion 102 relative to the lower housing portion 104.

Figure 2:
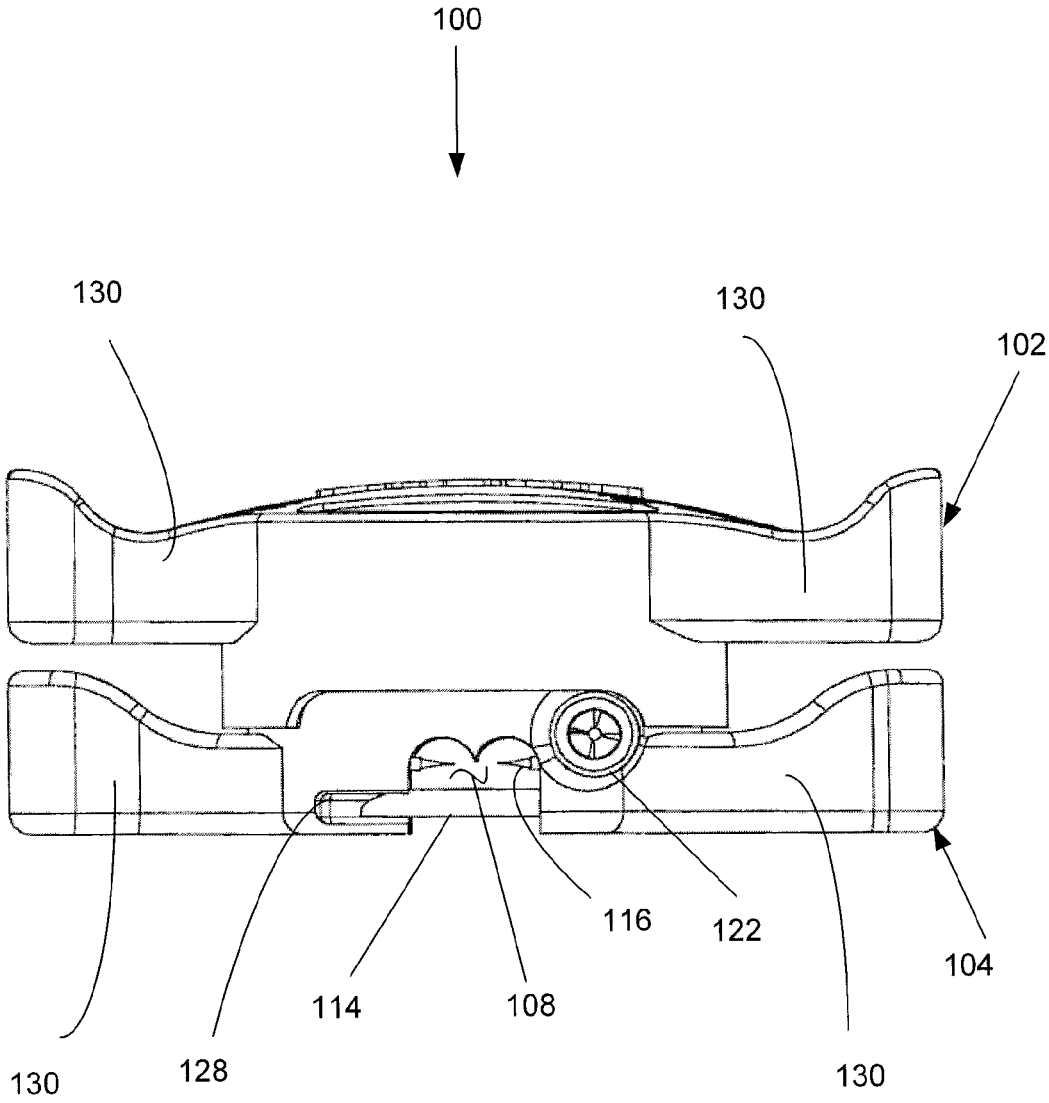
FIG. 2 is a front view of the electrical connector of FIG. 1 in a rotated position.

As shown in FIGS. 1 and 2, the lower housing portion 104 of the electrical connector 100 includes the secondary wire passageway 122 configured for receiving the secondary wire 120 (FIGS. 3 and 4) into the chamber 106 (FIG. 6B) of the lower housing portion 104. With additional reference to FIGS. 5A-5D, a retention member passageway 124 of the lower housing portion 104 is configured to allow passage of the retention member 114 from the chamber 106 (FIG. 6B) of the lower housing portion 104 generally through the cavity 108 and to a securing fixture 128 on a generally opposite side of the cavity 108. A connection member passageway 126 is configured to allow passage of the primary conductive member 116 from the chamber 106 (FIG. 6B) of the lower housing portion 104 into the cavity 108. In the illustrated embodiment, the secondary wire passageway 122 is positioned on a side of the lower housing portion 104. The connection member passageway 126 is positioned proximate to a center portion of the primary wire 112 (FIGS. 3 and 4) when received within the cavity 108.

The retention member passageway 124 of the lower housing portion 104, as shown in FIG. 6B, is positioned proximate to a bottom surface 110 of the lower housing portion 104. The lower housing portion 104 also includes the securing fixture 128 for receiving an end of the retention member 114 following rotation of the upper housing portion 102 relative to the lower housing portion 104. Retention member 114 is dimensioned to extend across cavity 108 from the retention member passageway 124 and engage with the retention fixture 128.

The electrical connector 100, in some exemplary embodiments, can include a moisture resistant encapsulant positioned within the chamber 106 (FIG. 6B) of the lower housing portion 104 to encapsulate a portion of the primary conductive member 116 and a portion of the secondary conductive member 118, thereby encapsulating the fractured portion of the secondary wire 120 (FIGS. 3 and 4) and at least partially restricting the introduction of moisture into the chamber 106 (FIG. 6B) of the lower housing portion 104 from the retention member passageway 124, the connection member passageway 126, and/or the secondary wire passageway 122.

In the illustrated embodiment of the connector 100, the retention member 114, the primary conductive member 116 and the secondary conductive member 118 are formed as a monolithic member body (e.g., FIG. 7, etc., also referred to as an engagement member) configured to electrically couple, at the least, the primary conductive member 116 (FIGS. 3 and 4) and the secondary conductive member 118 (FIGS. 3 and 4). In alternative exemplary embodiments, a portion of the retention member 114 extending through the retention member passageway 124 and extending into the cavity 106 (FIG. 6B) of the lower housing portion 104 is electrically isolated from the primary conductive member 116 and the secondary conductive member 118. In some exemplary embodiments, the monolithic member body may include zinc.

In some exemplary embodiments of the connector 100, wherein the monolithic member body includes zinc, the embodiments may further comprise a moisture resistance encapsulant positioned within the chamber 106 (FIG. 6B) of the lower housing portion 104 to encapsulate at least a portion of the monolithic member body, for example at least a portion of the retention member 114, at least a portion of the primary conductive member 116 and/or at least a portion of the secondary conductive member 118, and allow completion of the electrical contact with, for example, the secondary wire 120 (FIGS. 3 and 4) and at least partially restricting the introduction of moisture about, for example, the contacted secondary conductors 120 and at least partially sealing the chamber 106 upon rotation of the upper housing portion 102. In some exemplary embodiments, the rotation of the upper housing portion 102 relative to the lower housing portion 104 is less than or equal to 90 degrees.

The retention member 114 of the electrical connector 100 can be configured to at least partially secure the received primary wire 112 (FIGS. 3 and 4) before the primary conductive member 116 extends into the cavity 108. In various exemplary embodiments of the connector 100, the upper housing portion 102 and the lower housing portion 104 may include user grip fixtures 130 (FIG. 2). Each user grip fixture 130 may be configured to enable a user to rotate the upper housing portion 102 relative to the lower housing portion 104. In the illustrated embodiment, the grip fixtures 130 are wings. Alternative grip fixtures can include knurls, edged shapes, etc.

Referring to FIG. 3, a bottom view of the connector 100 is shown with the connector 100 in an open position. Here, the connector 100 is shown configured for receiving two primary wires 112 into the cavity 108 and two secondary wires 120 into the wire passageways 122. The grip fixtures 130 are illustrated as wings. The primary wires 112 may feed low voltage power to one or more of the secondary wires 120, and the primary power may be tapped by rotation of the upper housing portion 102 relative to the lower housing portion 104. The low voltage power source can be either AC or DC and when the connectors are used in an outdoor environment, an encapsulant can be included for moisture protection of the tapped power. In alternative applications, such as indoor low power distribution, an encapsulant may not be used. While the illustrated embodiment shows two separate primary wires 112, each having a single conductor (not shown) and each received within the cavity 108, alternative embodiments can be configured to engage individual stranded conductor wires and/or Siamese cable pair cables, by way of example. In still other exemplary embodiments, connectors may be configured to connect to a primary wire, and electrically couple the primary wire to one or more secondary wires. The illustrated embodiment is not intended to limit the scope of the disclosure.

FIG. 4 shows the connector 100 of FIG. 3 after rotation of the upper housing portion 102 relative to the lower housing portion 104. The primary conductive member 116 has fractured the insulation of the primary conductor 112 and electrically engaged the conductor (not shown) of the primary wire 112. Retention member 114 is shown engaged with securing fixture 128.

Figure 5A:
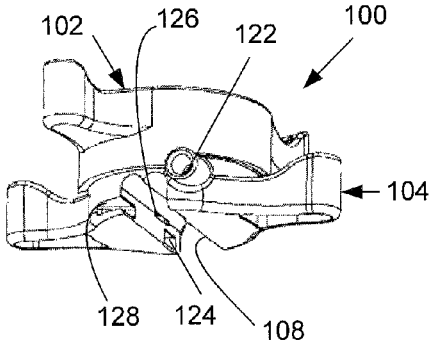
FIG. 5A is a bottom perspective view of the electrical connector of FIG. 1, without wires, and in the open position.
Figure 5C:
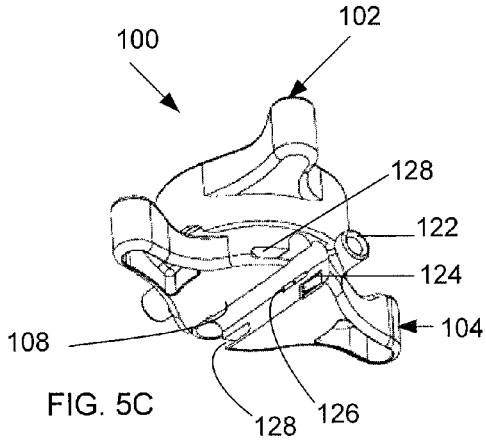
FIG. 5C is a bottom perspective view of the electrical connector of FIG. 1, without wires, and in the open position.
Figure 5B:
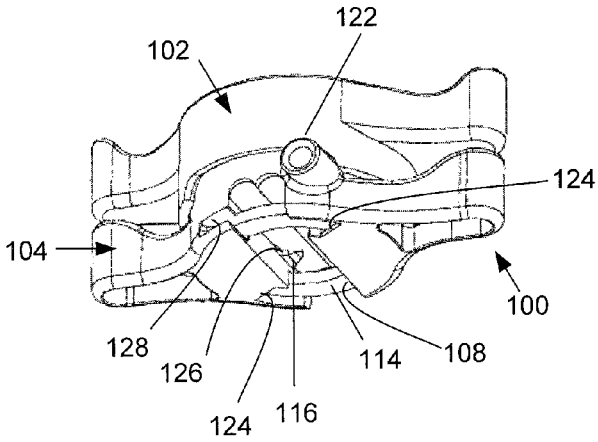
FIG. 5B is the bottom perspective view of the electrical connector of FIG. 5A in the rotated position.
Figure 5D:
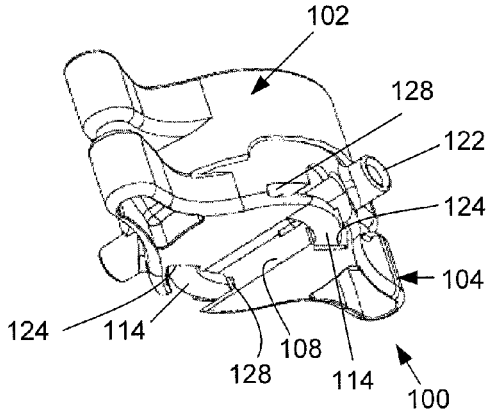
FIG. 5D is the bottom perspective views of the electrical connector of FIG. 5C in the rotated position.
Figure 7A:
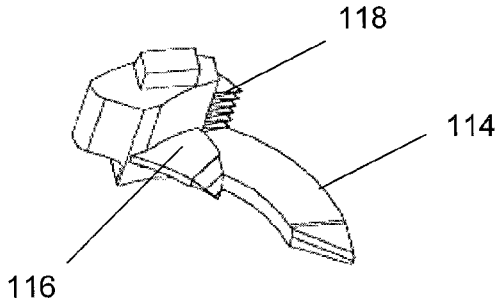
FIG. 7A is a perspective view of an engagement member of the electrical connector of FIG. 1.
Figure 7B:
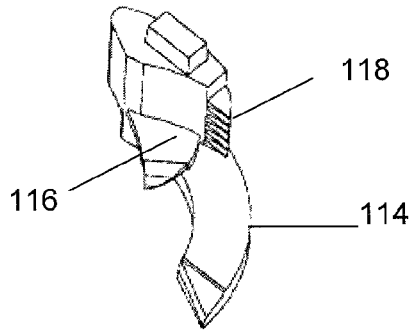
FIG. 7B is a perspective view of the engagement member similar to FIG. 7A.
Figure 7C:
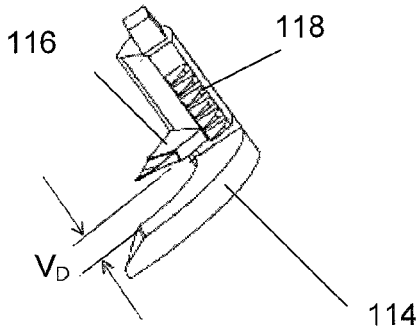
FIG. 7C is a perspective view of the engagement member similar to FIG. 7B.
Figure 7D:
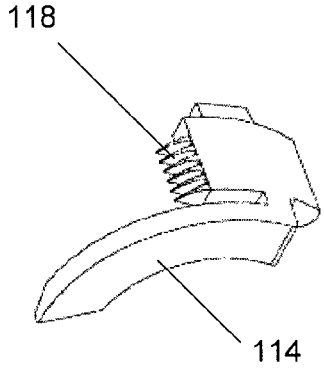
FIG. 7D is a perspective view of the engagement member similar to FIG. 7C.
Figure 8A:
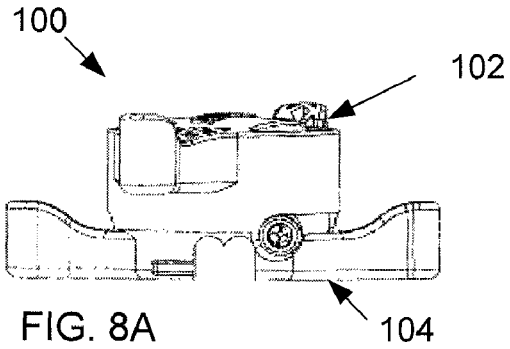
FIG. 8A is a front elevation view of the electrical connector of FIG. 1 in the open position.
Figure 8D:
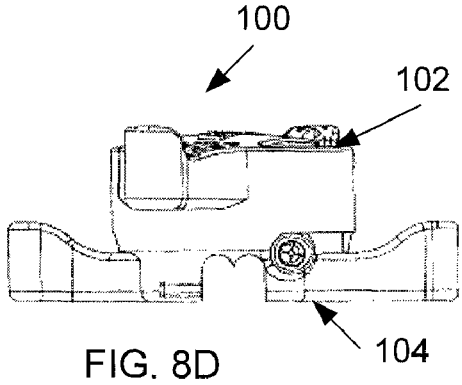
FIG. 8D is a rear elevation view of the electrical connector of FIG. 1 in the open position.
Figure 8B:
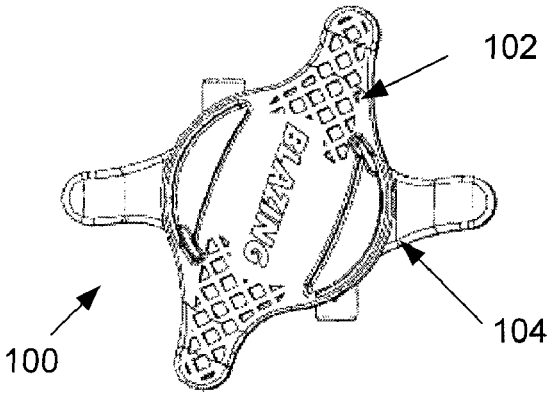
FIG. 8B is a top plan view of the electrical connector of FIG. 1 in the open position.
Figure 8C:
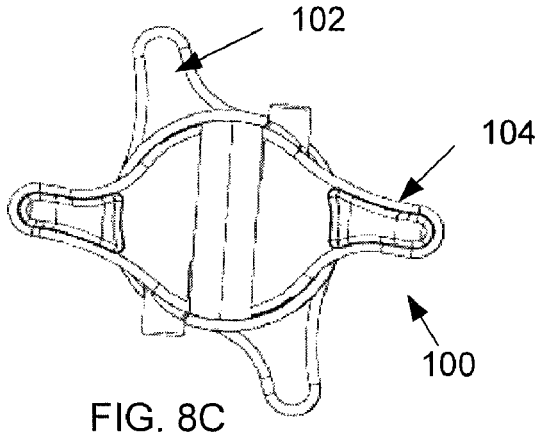
FIG. 8C is a bottom plan view of the electrical connector of FIG. 1 in the open position.
Figure 8E:
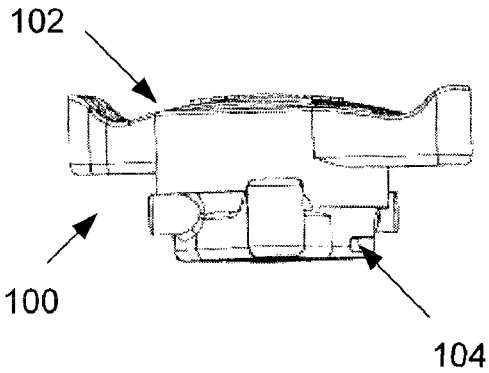
FIG. 8E is a left side elevation view of the electrical connector of FIG. 1 in the open position.
Figure 8F:
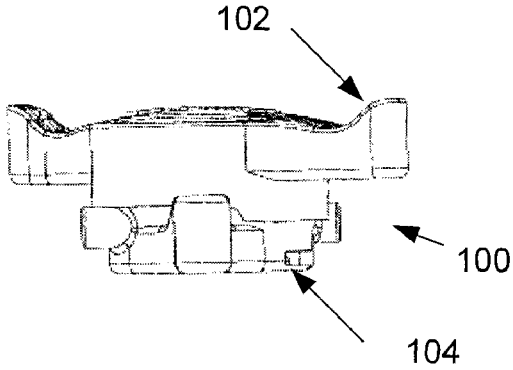
FIG. 8F is a right side elevation view of the electrical connector of FIG. 1 in the open position.
Figure 9A:
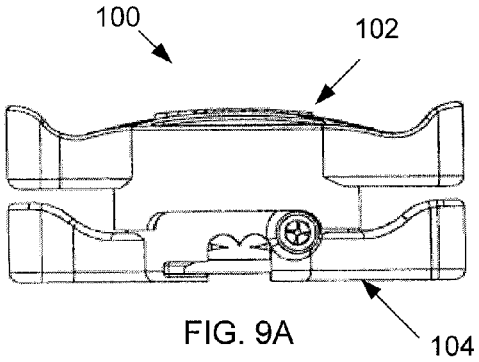
FIG. 9A is the front elevation view of the electrical connector of FIG. 8A in the rotated position.
Figure 9D:
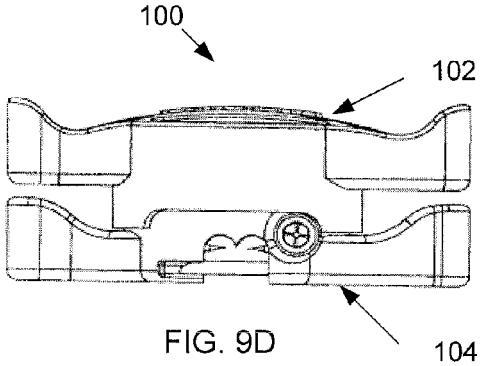
FIG. 9D is the rear elevation view of the electrical connector of FIG. 8D in the rotated position.
Figure 9B:
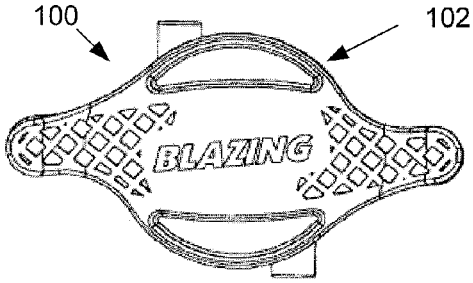
FIG. 9B is the top plan view of the electrical connector of FIG. 8B in the rotated position.
Figure 9C:
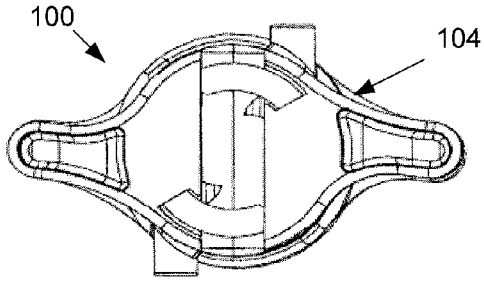
FIG. 9C is the bottom plan view of the electrical connector of FIG. 8C in the rotated position.
Figure 9E:
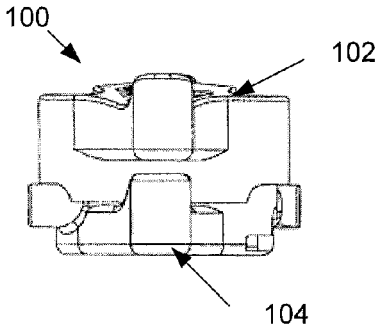
FIG. 9E is the left side elevation view of the electrical connector of FIG. 8E in the rotated position.
Figure 9F:
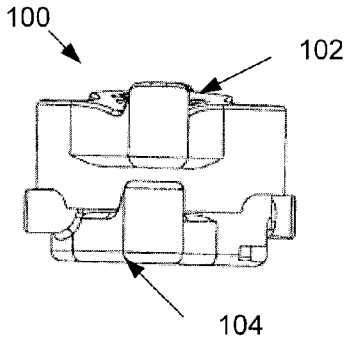
FIG. 9F is the right side elevation view of the electrical connector of FIG. 8F in the rotated position.

FIGS. 5A-5D show the connector 100 in open (FIGS. 5A and 5C) and rotated positions (FIGS. 5B and 5D) without wires. FIGS. 5A and 5C illustrate the 180 degree rotational symmetry of the connector 100 and shows the securing fixtures 128, connection member passageways 126, and retention member passageways 124 within the lower housing portion 104. FIG. 5B shows the rotated position of FIG. 5A wherein the primary conductive member 116 has passed through the connection member passageway 126 of the lower housing member 104 to fracture the insulation of a primary wire 112 (not shown) positioned within the cavity 108 and electrically engage the conductor of primary wire 112. FIG. 5D shows the rotated position of FIG. 5C and illustrates the retention members 114 engaged with the securing fixtures 128.

FIGS. 6A and 6B show the upper housing portion 102 and the lower housing portion 104 of the connector 100, and further illustrate the structure of the monolithic member bodies, each including the retention member 114, the primary conductive member 116, and the secondary conductive member 118 in relation to the upper housing portion 102 (FIG. 6A) and the lower housing portion 104 (FIG. 6B). As shown, the monolithic member bodies are rotationally displaced by about 180 degrees. Each primary conductive member 116 is configured for fracturing the insulation of a primary wire 112 (FIGS. 3 and 4) and engaging the primary wire's conductor upon rotation of the upper housing portion 102 relative to the lower housing portion 104. FIG. 6B further illustrates the chamber 106 and the positioning of each monolithic member body, wherein the secondary conductive member 118 of each body is configured for engaging a secondary wire 120 (FIGS. 3 and 4) received through the secondary wire passageway 122 upon rotation of the upper housing portion 102 relative to the lower housing portion 104. Also shown is the retention member passageway 124 configured for receiving an end of the retention member 114 upon rotation of the upper housing portion 102 relative to the lower housing portion 104. The primary conductive member 116 is dimensioned and configured for passing through the connection member passageway 126 to fracture the primary wire 112 (FIGS. 3 and 4) and electrically engage a conductor of the primary wire 112.

FIGS. 7A-7D illustrate the monolithic member body of the connector 100, including the retention member 114, the primary conductive member 116, and the secondary conductive member 118. Perspective view 7B shows that retention member 114 and secondary conductive member 118 are generally aligned along a common sector, wherein the sector length of the secondary conductive member 118 is generally shorter than the sector length of the retention member 114. As previously described, the sector length of the retention member 114 is dimensioned to cross cavity 108 and engage securing fixture 128 (e.g., FIG. 4, etc.). The length of the secondary conductive member 118 and its associated teeth are dimensioned to engage a secondary wire 120 upon rotation of the upper housing portion 102 relative to the lower housing portion 104 (FIGS. 3 and 4). The sector length of the primary conductive member 116 is dimensioned generally shorter that the sector length of the retention member 114 and configured to engage a primary wire 112 upon rotation of the upper housing portion 102 relative to the lower housing portion 104 (FIGS. 3 and 4). The vertical displacement space, VD, shown in FIG. 7C between the retention member 114 and the primary conductive member 116 is dimensioned to receive and retain the primary wire 112 upon, for example, partial rotation of the upper housing portion 102 relative to the lower housing portion 104 and before the primary conductive member 116 fractures the insulation covering of a primary wire 112 and electrically engages the primary wire conductor (e.g., FIGS. 3 and 4, etc.).

FIGS. 8A-8F illustrate the connector 100 in an open position and without wires. And FIGS. 9A-9E illustrate similar views to FIGS. 8A-8F of the connector 100 after rotation of the upper housing portion 102 relative to the lower housing portion 104.

In operation, as described above, one or more exemplary embodiments of the electrical connectors described herein can be utilized to establish an electrical connection between a primary wire and a secondary wire. As such, one or more exemplary methods are also within the scope of this disclosure for establishing the electrical connection.

In one exemplary method of electrically tapping a wire, an intermediate portion of a primary wire may be inserted into an open cavity defined by a housing having an upper portion and a lower portion. The upper housing portion can be rotated relative to the lower housing portion and electrical connection can thus be established by a conductor of the primary wire responsive to the rotating to complete electrical contact with a conductor of a secondary wire. Establishing the electrical connection with the primary wire conductor can include fracturing and/or penetrating an insulating covering of the primary wire to make contact with a conductor therein. Additionally, establishing the electrical connection with the primary wire conductor can be simultaneous with, before, or after the securing of the primary wire within the open cavity during the rotating of the upper housing portion relative to the lower housing portion. As noted above, this can also include securing the primary wire within the open cavity responsive to the rotating.

Additionally, as noted above, a secondary wire can also be coupled to the electrical connector. In some cases, an end of a secondary wire can be inserted through a secondary passageway and into a chamber. Additionally, in some exemplary embodiments, the rotation or other operation can result in the completing of electrical contact with the secondary wire conductor such as through fracturing and/or penetration of the insulating covering of the secondary wire.

A moisture resistant encapsulant can be positioned within the chamber wherein the moisture resistant encapsulant is distributed within the chamber and possibly to or within one or more passageways connected to the chamber to at least partially restrict the introduction of moisture into the chamber.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

It will also be understood that, although the terms first, second, third etc. and/or primary, secondary, etc. may be used herein to describe various elements, components, regions, portions, and/or sections, these elements, components, regions, portions, and/or sections should not be limited by these terms. These terms are only used to distinguish one element, component, region, portion, or section from another element, component, region, portion, or section. Thus, a first element, component, region, portion, or section discussed below could be termed a second element, component, region, portion, or section without departing from the scope of the example embodiments.

Certain terminology may be used herein for purposes of reference only, and thus is not intended to be limiting. For example, terms such as "upper", "lower", "above", and "below" refer to directions in the drawings to which reference is made. Terms such as "front", "forward", "back", "rear", "rearward", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order or quantity unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted.

The present disclosure is merely exemplary in nature and, thus, variations that do not depart from the gist of the present disclosure are intended to be within the scope of the present disclosure. Such variations are not to be regarded as a departure from the spirit and scope of the present disclosure.

What is claimed is:

1. An electrical connector comprising:

a housing having an upper portion and a lower portion rotatable relative to each other, a chamber, and a cavity configured to receive a first wire;

a first conductive member positioned within the chamber configured to extend into the cavity and establish electrical contact with a conductor of the first wire upon rotation of the upper housing portion relative to the lower housing portion;

a second conductive member capable of being electrically coupled to a conductor of a second wire, the housing including a second wire passageway configured for receiving the second wire into the chamber of the housing, the second conductive member being electrically coupled to the first conductive member, wherein electrical conductivity can be established between the conductor of the first wire and the conductor of the second wire through the second conductive member; and a moisture resistant encapsulant positioned within the chamber to at least partially restrict the introduction of moisture through the second wire passageway and at least partially seal the chamber;

wherein the second conductive member is configured to rotate within the chamber to fracture a portion of any insulating covering of the second wire positioned in the chamber and to complete the electrical coupling to the conductor of the second wire upon the rotation of the upper housing portion relative to the lower housing portion.

2. The electrical connector of claim 1 wherein the housing includes a connection member passageway configured to allow passage of the first conductive member from the chamber into the cavity.

3. The electrical connector of claim 2 wherein the connection member passageway is positioned proximate to a center portion of the first wire when received within the cavity.

4. The electrical connector of claim 1 wherein the first conductive member and the second conductive member are portions of a monolithic member body configured to electrically couple the conductors of the first and second wires upon rotation of the upper housing portion relative to the lower housing portion.

5. The electrical connector of claim 4 wherein the monolithic member body includes zinc.

6. The electrical connector of claim 1, further comprising a retention member adapted for at least partially securing a first wire positioned within the cavity.

7. The electrical connector of claim 6 wherein the housing includes a retention member passageway configured for passage of the retention member from the chamber to the cavity and wherein the retention member is positioned within the chamber and configured to at least partially extend into and across at least a portion of the cavity and at least partially secure a received first wire upon rotation of the upper housing portion relative to the lower housing portion.

8. The electrical connector of claim 7 wherein the retention member passageway is positioned proximate to a bottom surface of the lower housing portion, the lower housing portion including a securing fixture for receiving an end of the retention member following the rotation, and the retention member being dimensioned to extend across the cavity from the retention member passageway and engage the securing fixture.

9. The electrical connector of claim 6 wherein a portion of the retention member extending through the retention member passageway and extending into the cavity is electrically isolated from the first conductive member and the second conductive member.

10. The electrical connector of claim 6 wherein the retention member is configured to at least partially secure the received first wire before the first conductive member extends into the cavity.

11. The electrical connector of claim 1 wherein the rotation of the upper housing portion relative to the lower housing portion is less than or equal to about 180 degrees.

12. The electrical connector of claim 1 wherein the upper housing portion includes an upper user grip fixture and the lower housing portion includes a lower user grip fixture, each user grip fixture being configured to enable a user to rotate the upper housing portion relative to the lower housing portion.

13. An electrical connector comprising:

a housing having an upper portion and a lower portion rotatable relative to each other, said lower portion comprised a chamber, a cavity configured to receive a first wire, a wire passageway for receiving a second wire, a retention member passageway between the chamber and the cavity, and a connection member passageway between the chamber and the cavity;

an engagement member having a retention member, a first conductive member, and a second conductive member electrically coupled to the first conductive member, the retention member being configured to extend through the retention member passageway and into and across at least a portion of the cavity to at least partially secure a first wire received within the cavity, the first conductive member being configured to extend through the connection member passageway and into the cavity to establish electrical contact with a conductor of the secured first wire, and the second conductive member being configured to rotate within the chamber and complete electrical contact with a conductor of a second wire received within the chamber through the wire passageway, each being responsive to a rotation of the upper housing portion relative to the lower housing portion; and a moisture resistant encapsulant positioned within the chamber to at least partially restrict the introduction of moisture into the chamber through the wire passageway and to thereby at least partially seal the chamber.

14. An electrical connector comprising:

a housing having an upper portion and a lower portion rotatable relative to each other and configured to be mounted on a primary wire generally between end portions of the primary wire, and defining a passageway for receiving a secondary wire at least partially into a chamber of the housing;

an engagement member disposed at least partially within the housing and moveable relative to the housing between a first position in which the housing can be mounted on the primary wire and the secondary wire can be received within the passageway, and a second position in which electrical conductivity can be established between the primary wire and the secondary wire through the engagement member; and a moisture resistant encapsulant positioned within the chamber to at least partially restrict the introduction of moisture into the chamber through the wire passageway and to thereby at least partially seal the chamber when electrical conductivity is established between the primary wire and the secondary wire;

wherein the engagement member includes a first conductive member configured to contact the primary wire when the engagement member is in the second position, and a second conductive member configured to contact the secondary wire when the engagement member is in the second position, and wherein the first conductive member is electrically coupled to the second conductive member for establishing the electrical conductivity between the primary wire and the secondary wire through the engagement member.

15. The electrical connector of claim 14, wherein the engagement member further includes a retention member configured to at least partially secure the housing on the primary wire when the engagement member is in the second position.

16. The electrical connector of claim 14, wherein the first conductive member is configured to fracture at least a portion of any insulating covering of the primary wire when the engagement member moves to the second position, and wherein the second conductive member is configured to fracture at least a portion of any insulating covering of the secondary wire when the engagement member moves to the second position.

17. The electrical connector of claim 14, wherein the housing defines a cavity configured to receive the primary wire when the housing is mounted on the primary wire, and wherein at least part of the engagement member extends into the cavity and at least part of the engagement member extends into the passageway when the engagement member is in the second position for establishing the electrical conductivity between the primary wire and the secondary wire through the engagement member.

18. The electrical connector of claim 14, wherein at least part of the engagement member establishing the electrical conductivity between the primary wire and the secondary wire is formed from zinc.

19. The electrical connector of claim 14, wherein the housing is configured to be mounted on at least two primary wires, and defines passageways for receiving each of at least two secondary wires into the chamber of the housing, and wherein the engagement member is configured to establish electrical conductivity between at least one of the at least two primary wires and at least one of the at least two secondary wires.

20. An electrical connector comprising:

an upper portion and a lower portion rotatable relative to each other a cavity configured to receive a primary wire at least partially into the cavity;

a chamber configured to receive a secondary wire at least partially into the chamber;

a first conductive member configured to be electrically coupled to a conductor of the primary wire;

a second conductive member electrically coupled to the first conductive member, the second conductive member configured to be electrically coupled to a conductor of the secondary wire to thereby establish electrical conductivity between the conductor of the primary wire and the conductor of the secondary wire; and a moisture resistant encapsulant positioned within the chamber to at least partially restrict the introduction of moisture into the chamber and to thereby at least partially seal the chamber when electrical conductivity is established between the primary wire and the secondary wire;

wherein the first conductive member and the second conductive member are both moveable relative to the cavity and the chamber between an open position and a closed position; in the open position, the first conductive member is positioned to receive the primary wire into the cavity and the second conductive member is position to receive the secondary wire into the chamber; and in the closed position, the first conductive member is positioned in engagement with the conductor of the primary wire and electrically coupled thereto and the second conductive member is positioned in engagement with the conductor of the secondary wire and electrically coupled thereto to thereby establish the electrical conductivity between the primary wire and the secondary wire.

21. The electrical connector of claim 20, further comprising a wire passageway for receiving the secondary wire at least partially into the chamber, the moisture resistant encapsulant positioned within the chamber to at least partially restrict the introduction of moisture into the chamber through the wire passageway.

22. The electrical connector of claim 21, wherein the chamber is substantially enclosed such that access into the chamber is limited to the wire passageway.

23. The electrical connector of claim 21, wherein chamber is configured to receive an end portion of the secondary wire.

24. The electrical connector of claim 23, wherein the cavity is configured to receive a portion of the primary wire disposed between end portions of the primary wire.

25. The electrical connector of claim 20, wherein the chamber is configured to receive at least two or more secondary wires at least partially into the chamber.

26. The electrical connector of claim 25, wherein the cavity is configured to receive at least two or more primary wires at least partially into the cavity.

* * * * *

UNITED STATES PATENT AND TRADEMARK OFFICE

CERTIFICATE OF CORRECTION

PATENT NO. : 7,806,718 B2
APPLICATION NO. : 11/877543
DATED : October 5, 2010
INVENTOR(S) : Thomas A. King et al.

It is certified that error appears in the above-identified patent and that said Letters Patent is hereby corrected as shown below:

Claim 13, column 12, lines 39-40: replace "said lower portion comprised a chamber" with -- said lower portion comprising a chamber --

Claim 20, column 14, lines 4-5: replace "an upper portion and a lower portion rotatable relative to each other" with -- an upper portion and a lower portion rotatable relative to each other; --

Claim 20, column 14, line 29: replace "the second conductive member is position to" with -- the second conductive member is positioned to --

Signed and Sealed this
Eleventh Day of January, 2011

David J. Kappos

David J. Kappos
*Director of the United States Patent and Trademark Office*